US007795517B2

(12) United States Patent
Miller

(10) Patent No.: US 7,795,517 B2
(45) Date of Patent: Sep. 14, 2010

(54) PYTHAGOREAN FRET PLACEMENT

(76) Inventor: Steven Richard Miller, P.O. Box 2493, Kealakekua, HI (US) 96750

( * ) Notice: Subject to any disclaimer, the term of this patent is extended or adjusted under 35 U.S.C. 154(b) by 0 days.

(21) Appl. No.: 11/869,402

(22) Filed: Oct. 9, 2007

(65) Prior Publication Data

US 2008/0034942 A1 Feb. 14, 2008

Related U.S. Application Data

(63) Continuation-in-part of application No. 11/164,812, filed on Dec. 6, 2005, now abandoned.

(51) Int. Cl.
*G10D 3/06* (2006.01)

(52) U.S. Cl. ..... 84/314 R; 84/293

(58) Field of Classification Search ..... 84/293, 84/314 R

See application file for complete search history.

(56) References Cited

U.S. PATENT DOCUMENTS

| | | | | |
|---|---|---|---|---|
| 1,851,744 | A * | 3/1932 | Wellington | 235/61 GM |
| 2,649,828 | A | 8/1953 | Maccaferri | |
| 2,885,795 | A * | 5/1959 | Feldhake | 434/212 |
| 3,951,031 | A | 4/1976 | Barcus et al. | |
| 4,132,143 | A | 1/1979 | Stone | |
| 5,063,818 | A | 11/1991 | Salazar | |
| 5,404,783 | A | 4/1995 | Feiten et al. | |
| 5,481,956 | A * | 1/1996 | LoJacono et al. | 84/314 N |
| 5,600,079 | A | 2/1997 | Feiten et al. | |
| 5,728,956 | A | 3/1998 | Feiten et al. | |
| 5,814,745 | A | 9/1998 | Feiten et al. | |
| 5,955,689 | A | 9/1999 | Feiten et al. | |
| 6,069,306 | A | 5/2000 | Isvan et al. | |
| 6,143,966 | A | 11/2000 | Feiten et al. | |
| 6,359,202 | B1 | 3/2002 | Feiten et al. | |
| 6,642,442 | B2 | 11/2003 | Feiten et al. | |
| 6,750,387 | B2 | 6/2004 | Jamkhedkar et al. | |
| 6,870,084 | B2 | 3/2005 | Feiten et al. | |

(Continued)

OTHER PUBLICATIONS

Coleman, Howard and Rickard, Doug, "Fretting Calculations,"Fretting Calculation, © 2001. Also see the related Coleman, Howard, "Two Fretting Methods Compared," p. 1, © 1999. p. 2, calculations 2008 by examiner.*

Pythagorean Theorem, viewed Nov. 4, 2008 at http://en.wikipedia.org/wiki/Pythagorean_theorem, the underlying subject matter dating back over 2000 years.*

(Continued)

*Primary Examiner*—Jeffrey Donels
*Assistant Examiner*—Robert W Horn
(74) *Attorney, Agent, or Firm*—McCormick, Paulding & Huber LLP

(57) ABSTRACT

The method provides luthiers of fretted instrument with a novel approach for installing frets with increased accuracy. The method is an improvement in calculation of fret placement over the "Rule of 18" because it relies on the length of the vibrating string. This method is more pronounced at the end of the fret board closest to the bridge due to the angle formed by the string when depressed with respect to the axis of the fret board. With respect to the twelve-step octave, the scale length is multiplied by the constant of the twelfth root of 0.5 to calculate the length of the string from fret contact to saddle contact for the next tonal step.

12 Claims, 1 Drawing Sheet

U.S. PATENT DOCUMENTS

| | | | | |
|---|---|---|---|---|
| 2003/0029298 | A1 | 2/2003 | Feiten et al. | |
| 2004/0069114 | A1 | 4/2004 | Feiten et al. | |
| 2005/0155479 | A1 | 7/2005 | Feiten et al. | |
| 2006/0037460 | A1* | 2/2006 | Salazar | 84/314 R |
| 2007/0131084 | A1 | 6/2007 | Miller | |

OTHER PUBLICATIONS

Coleman, Howard, Intonation of Acoustic Guitars, © 1999.*
Stewart-McDonald, Fret Scale Rule, © 2008, viewed Oct. 30, 2008.*
Fletcher, Neville, et al., The Physics of Musical Instruments, © 1998 Spinger, p. 263, section 9.14, Frets and Compensation.*

* cited by examiner

PYTHAGOREAN FRET PLACEMENT

CROSS REFERENCE TO RELATED APPLICATIONS

This application is a continuation-in-part of U.S. patent application Ser. No. 11/164,812, filed on Dec. 6, 2005, titled "PYTHAGOREAN FRET PLACEMENT," herein incorporated by reference in its entirety.

FIELD OF THE INVENTION

This invention relates in general to musical instrument construction, specifically with respect to fret placement and fret boards for stringed instruments. More particularly, the invention deals with a Pythagorean approach to fret placement for stringed instruments.

BACKGROUND OF THE INVENTION

In the construction of the neck of stringed instruments, fret placement is important in order to achieve proper intonation. Much has been done to improve intonation through a variety of methods. One such method is the "Rule of 18." Under this rule, starting with the first fret from the nut, each fret is placed at $^{17}/_{18}$ of the previous fret's distance to the bridge. However, practice has shown that this rule is flawed.

With the forgoing problems and concerns in mind, it is the general object of the present invention to provide a novel approach to fret placement, which overcomes the above-described drawbacks while improving intonation of a stringed instrument in the assembling process.

SUMMARY OF THE INVENTION

It is an object of the present invention to provide a stringed musical instrument having frets placed according to a method that recognizes a right triangle is formed, outlined by the axis of a fingerboard, a string, and the height of the string above the tangential point of string contact with the fret and perpendicular to a tangential point of string contact at the saddle.

It is another object of the present invention to provide a stringed musical instrument having frets placed according to a method that calculates the position of a fret on a fret board by measuring the required distance along the axis of the string, where the full string length will span from the point of contact on the saddle to the point of contact on the fret.

It is another object of the present invention to provide a stringed musical instrument having frets placed according to a method that involves multiplying the scale length by the twelfth root of 0.5 and multiplying each successive length by the twelfth root of 0.5 in order to provide the necessary string distances at which to place frets on a fret board for a twelve step octave.

These and other objectives of the present invention, and their preferred embodiments, shall become clear by consideration of the specification, claims and drawings taken as a whole.

DETAILED DESCRIPTION OF THE PREFERRED EMBODIMENT

The present invention is used for the manufacturing of fretted stringed instruments. More specifically, the present invention is a method for improving placement of frets on fretted musical instruments.

Figure 1:
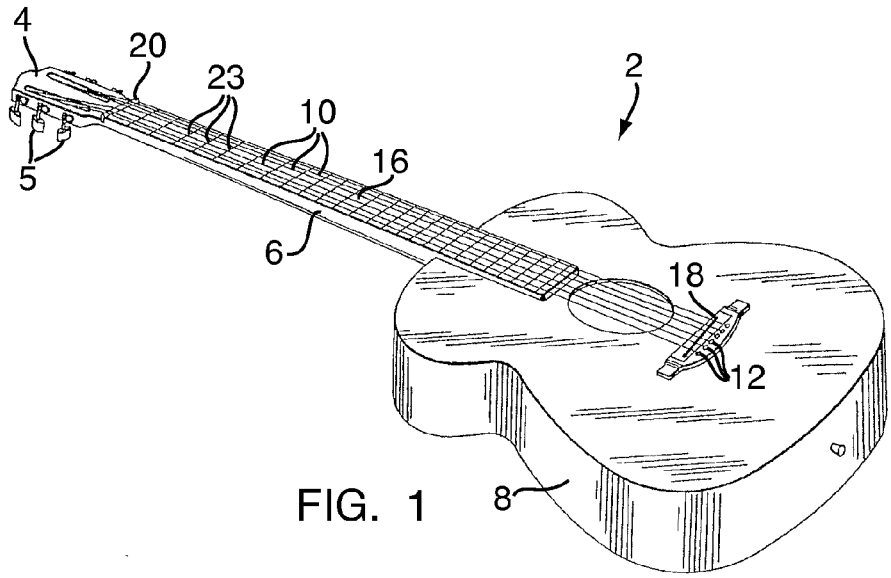
FIG. 1 is a simplified schematic illustration of a guitar showing the fret placement of the present invention.

As shown in FIG. 1, the method of fret placement of the present invention is applied to a stringed musical instrument 2. The stringed musical instrument 2 is of a conventional design having a tuning head 4, neck 6, and body 8. The neck 6 is attached to the body 8. At the distal end of the neck 6 opposing the body 8, the tuning head 4 is attached. Strings 10 are attached to the tuning head 4 and stretched over a saddle 18 for connection to anchor pins 12. The tuning head 4 is fitted with tuning keys 5, which adjust the tension of the strings 10. Adjusting the tension of the strings 10 affects the pitch of the instrument 2.

Still referring to FIG. 1, a nut 20 is attached at the joint wherein the tuning head 4 meets the neck 6. The neck 6 includes a fingerboard 16. The nut 20 guides the strings 10 onto the fingerboard 16 to provide consistent lateral string placement. Frets 23 are placed along the major axis of the fingerboard 16, according to the method of the present invention.

The tone of the stringed musical instrument 2 is produced by vibration of the strings 10 and modulated by the hollow body 8. When the string 10 is depressed to the fingerboard 16, two specific things happen. First, the vibrating length of the string 10 becomes shorter, which produces a higher pitch. Second, the string 10 forms a right triangle with an axis parallel to the fingerboard 16 and the altitude of the string 10. Based on these concepts, the present invention addresses the concept of string vibration and the layout of the fingerboard 16 as a three-dimensional exercise designed to achieve improved intonation. The present method is neither a compensation nor a tempering of the strings. In fact, no one compensation can be successful in attaining perfect intonation since the mechanism involved is not linear. The method of the present invention will be described in more detail below.

It is therefore an important aspect of the present invention that the present method accounts for string vibration and fingerboard layout in fret placement. Previously, frets were placed based on a linear exercise in math based on the Rule of 18. In other words, fret placement was heretofore based on a fixed point along the axis of the fingerboard. By employing the dimensions of the right triangle formed when a string 10 is depressed, intonation of a fretted stringed musical instrument 2 can be improved by the present invention. As such, fret placement is calculated along the axis of the string 10 from a tangential point of string contact on the saddle 18 to a tangential point of contact on a fret 23.

The traditional method places a fret 23 closer to a nut 20 of the instrument 2. However, the present method places a fret 23 closer to the saddle 18. As the fret 23 to be calculated approaches the saddle 18, the angle created by the axis of the string 10 and the axis of the fingerboard 16 increases. Thus, the location of each fret 23 placed by the present method may differ greatly from the location of a fret placed by traditional methods. The reason for this is due to the difference not being linear but rather based on the string height above the fingerboard 16. This string height is not accounted for by traditional methods.

Figure 2:
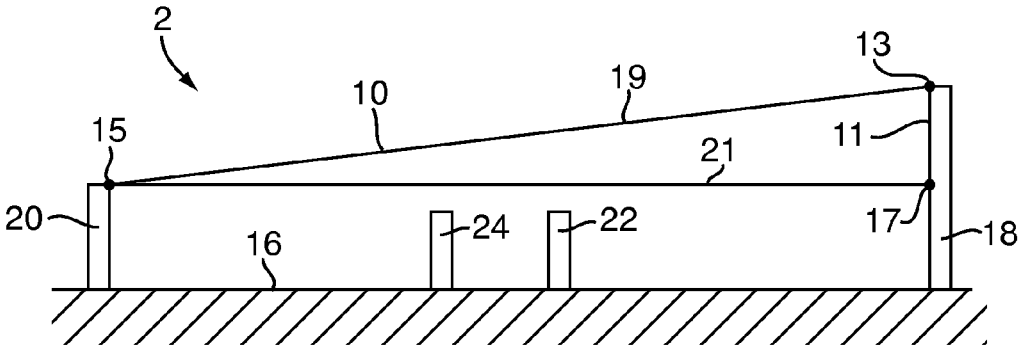
FIG. 2 is a side schematic view of an open string on the musical instrument of FIG. 1.

FIG. 2 illustrates side schematic view of an open, or unfretted, string 10 on the musical instrument 2, according to one embodiment of the present invention. The fingerboard 16 is also shown. The string 10 extends over the saddle 18 and the nut 20. The saddle 18 and nut 20 are located on opposing sides of the fingerboard 16. Although the present invention may be used to place any number of frets, only two frets are shown for illustrative purposes in FIG. 2, higher fret 22 and lower fret 24. The higher fret 22 is located on the fingerboard 16 between the saddle 18 and the nut 20 but closer to the saddle 18. The lower fret 24 is also located on the fingerboard 16 between the saddle 18 and the nut 20 but is closer to the nut 20.

The preliminary step for calculating fret placement according to the present invention involves calculating the right triangle formed from the open string length. The length of a first side 11 of the right triangle is calculated by determining the height difference between a point 13 and a point 15. Point 13 is a tangential point of contact between the string 10 and the saddle 18. Point 15 is a tangential point of contact between the string 10 and the nut 20. A point 17 represents one end point of side 11. The hypotenuse 19 of the triangle is the open length of the string 10, also known as the scale length. With side 11 and hypotenuse 19 known, the final side 21 can be calculated, which is also the effective scale length.

Figure 3:
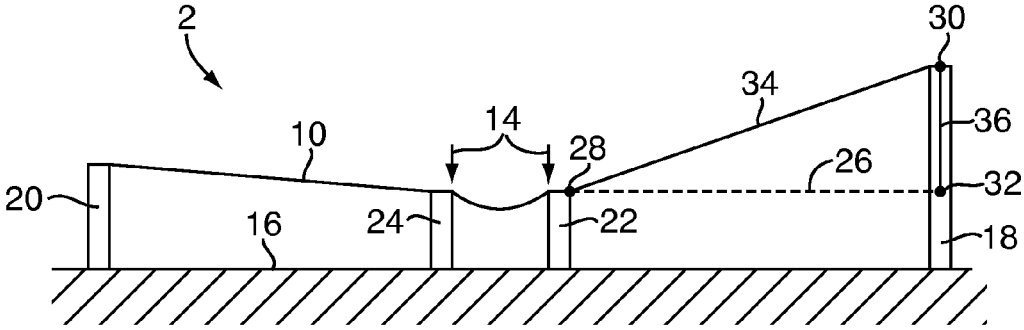
FIG. 3 is a side schematic view of a fretted string on the musical instrument of FIG. 1.

FIG. 3 illustrates a side schematic view of a fretted string 10 on the musical instrument 2, according to one embodiment of the present invention. A finger force depressing the string 10 is represented by two arrows 14. The fingerboard 16 is also shown in FIG. 3. The fretted string 10 extends over the saddle 18 and the nut 20.

Fret placement can now be calculated based on the right triangle formed from the points described below. The first step is to determine a string length corresponding to a note on an open string. The string length is the length of open string 10 of FIG. 2. Second, the target string length for each fret based on a known ratio of the open note string length for a selected scale must be determined. This length is represented in FIG. 3 as the length of fretted string 10 from point 28 to point 30, or line 34.

For the purpose of this step, the fret placement on an instrument 2 that employs a twelve-step octave will be used as an example. Starting with a scale length and multiplying that scale length by a constant that is less than one, the distance between two points of a shorter string, one step higher in pitch, can be determined. This is the equivalent of the placement of the first fret. If this new string length is multiplied by the constant again, the placement of the second fret can be calculated. This process can be continued to the twelfth fret, where the string length will be exactly one half the scale length. Based on this, the constant is determined to be the twelfth root of 0.5, which is a number less than one in excess of thirty decimal places. For the purposes of this description, the constant will be rounded off to 0.94387431268.

In contrast, the Rule of 18 uses a constant that is divided into the scale length. This results in the distance from the nut to the first fret and subsequently from one fret to the next. However, this method does not achieve proper intonation.

The present invention improves intonation on a fretted instrument by considering the length of the vibrating string. By multiplying the scale length by 0.94387431268, the length of string necessary to achieve the next higher step in tone for a twelve-tone-equal tempered scale can be determined.

Returning to the present method of fret placement and FIG. 3, the third step involves calculating a vertical distance between point 30 and point 32. Point 30 is a tangential point of contact between the fretted string 10 and the saddle 18. Point 32 is based on a horizontal axis 26 that spans from point 28 to the saddle 18. The horizontal axis 26 is parallel to the fingerboard 16. Point 28 is a tangential point of contact between the fretted string 10 and the higher fret 22. The vertical distance is best calculated as the shortest distance between point 30 and horizontal axis 26. Point 32 represents the point on the axis 26 where this shortest distance would be calculated. Thus, this distance is represented as line 36 on FIG. 1.

With line 34 and line 36 determined, the final step is determining the fret placement length on the fingerboard 16. This length is represented as the distance between point 28 and point 32, or the length of axis 26. The fret placement length is calculated by finding the square root of the difference of the target string length squared and the vertical distance between point 30 and point 32 squared. In other words, the length of axis 26 ($z$) is the square root of the difference of line 34($x$) squared and line 36($y$) squared. The equation is represented as:

$$z=\sqrt{(x^2-y^2)} \tag{1}$$

Unlike traditional methods, it is an important aspect of the present invention that it accounts for differing frets. Not all frets have tangential points of contact in the same position. As the fret 22 approaches the saddle 18 of the instrument, the angle created by the string 10 and the horizontal axis 26 increases. In turn, the tangential point of contact of the string 10 with the fret 22 offsets slightly. The higher the string height is above the finger board 16; the greater the disparity between the traditional method of fret placement and the present method. In addition, as the fret 23 approaches the tail of the instrument 2, the angle created by line 34 and the horizontal axis 26 increases. As a result, the difference between the two methods of fret placement also increases.

By multiplying each successive target string length by the twelfth root of 0.5, the necessary length of line 34 for each successive fret 23 can be calculated. Then, the length of line 36 can be determined based on the tangential point of contact between the fretted string 10 and the next successive fret 23. Finally, the fret placement for the next successive fret 23 can be calculated according to Equation (1), i.e., from the square root of the difference of new line 34 squared and new line 36 squared. This method can be repeated for each fret 23 to determine the distance of each respective fret 23 from the saddle 18.

The method can be applied to an actual stringed instrument. However, the present method may also be applied to a full-scale drawing of the stringed instrument for the calculations, and then, the frets placed on the actual instrument based on the measurements made on the drawing.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A method of constructing a fretted stringed musical instrument having a body with a saddle, a neck attached to the body at one of its distal ends and a tuning head attached to the other distal end, the neck having a fingerboard, the tuning head having tuning keys, a string attached to the tuning head by the tuning keys and stretched over the saddle, and frets along the major axis of the fingerboard, said method comprising the steps of:

determining a string length corresponding to a note on an open string;

determining a target string length for each fret based on a known ratio of the open note string length for a selected scale;

calculating a vertical distance from a tangential point of string contact on a saddle of said stringed instrument to a horizontal axis spanning from a tangential point of string contact on said fret to said saddle;

determining a fret placement length by calculating the square root of the difference of said target string length squared and said vertical distance squared; and positioning each fret on said fingerboard at said fret placement length.

2. The method of claim 1, wherein said selected scale is a temperament scale.

3. The method of claim 1, wherein said selected scale is a 12-tone-equal tempered scale.

4. The method of claim 3, wherein said known ratio is the twelfth root of 0.5.

5. A stringed musical instrument, comprising:

a body;

a neck attached to said body at one of its distal ends;

a tuning head attached to said neck at the other distal end;

tuning keys attached to said tuning head;

a fingerboard on said neck;

a saddle on said body;

a string attached to said tuning head by said tuning keys and stretched over said saddle, wherein said string has an open note string length and a target string length, wherein said target string length is based on a known ratio of an open note string length for a selected scale; and a fret spaced along said fingerboard at a target distance from said saddle, wherein said target distance is calculated based on the square root of the difference of said target string length squared and a vertical distance squared, wherein said vertical distance is based on a distance from a tangential point of string contact on said saddle of said stringed instrument to a horizontal axis spanning from a tangential point of string contact on said fret to said saddle.

6. The instrument of claim 5, wherein said selected scale is a temperament scale.

7. The instrument of claim 5, wherein said selected scale is a 12-tone-equal tempered scale.

8. The instrument of claim 7, wherein said known ratio is the twelfth root of 0.5.

9. A method of constructing a fretted stringed musical instrument having a body with a saddle, a neck attached to the body at one of its distal ends and a tuning head attached to the other distal end, the neck having a fingerboard, the tuning head having tuning keys, a string attached to the tuning head by the tuning keys and stretched over the saddle, and frets along the major axis of the fingerboard, said method comprising the steps of:

determining a string length corresponding to a note on an open string;

determining a target string length, L, for each fret based on a known ratio of the open note string length for a selected scale;

calculating a vertical distance, D, from a tangential point of string contact on a saddle of said stringed instrument to a horizontal axis spanning from a tangential point of string contact on said fret to said saddle;

determining a fret placement length, F, from the equation:

$$F=\sqrt{(L^2-D^2)}; \text{ and}$$

positioning each fret on said fingerboard at said fret placement length.

10. The method of claim 9, wherein said selected scale is a temperament scale.

11. The method of claim 9, wherein said selected scale is a 12-tone-equal tempered scale.

12. The method of claim 11, wherein said known ratio is the twelfth root of 0.5.

* * * * *